US009056348B2

(12) United States Patent
Kuo et al.

(10) Patent No.: US 9,056,348 B2
(45) Date of Patent: Jun. 16, 2015

(54) METHOD FOR MANUFACTURING BACK FRAME FOR FLAT PANEL DISPLAY DEVICE

(75) Inventors: Yi-cheng Kuo, Guandong (CN); Yu-chun Hsiao, Guandong (CN); Chengwen Que, Guandong (CN); Pangling Zhang, Guandong (CN); Dehua Li, Guandong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 405 days.

(21) Appl. No.: 13/640,726

(22) PCT Filed: Jul. 27, 2012

(86) PCT No.: PCT/CN2012/079300

§ 371 (c)(1),
(2), (4) Date: Oct. 11, 2012

(87) PCT Pub. No.: WO2014/015526

PCT Pub. Date: Jan. 30, 2014

(65) Prior Publication Data

US 2014/0026381 A1 Jan. 30, 2014

(51) Int. Cl.

| | |
|---|---|
| ***B21D 22/06*** | (2006.01) |
| ***B21D 35/00*** | (2006.01) |
| *B21D 22/02* | (2006.01) |

(52) U.S. Cl.

CPC ..... *B21D 35/001* (2013.01); *Y10T 29/49796* (2015.01); *B21D 22/06* (2013.01); *B21D 22/02* (2013.01)

(58) Field of Classification Search

CPC ..... B23P 17/04; B23P 21/004; B23P 21/002; B30B 15/00; B30B 11/04; B26F 1/40; B26F 2001/407; B26F 1/405; B26F 2001/3873; B21D 43/12; B21D 43/05; B21D 43/02; B21D 22/06; B21D 22/02

USPC ..... 29/429, 430, 819; 72/187, 373, 379.2, 72/464, 404, 405.01

See application file for complete search history.

(56) References Cited

U.S. PATENT DOCUMENTS

| | | | | | |
|---|---|---|---|---|---|
| 3,037,271 | A | * | 6/1962 | Schilberg | 29/415 |
| 3,880,020 | A | * | 4/1975 | Clem | 76/104.1 |
| 4,387,496 | A | * | 6/1983 | Spiegel | 29/416 |
| 4,928,512 | A | * | 5/1990 | Rooney et al. | 72/404 |
| 5,144,709 | A | * | 9/1992 | Rooney | 72/335 |
| 5,247,825 | A | * | 9/1993 | Erickson | 72/339 |
| 5,349,841 | A | * | 9/1994 | Honma et al. | 72/333 |
| 5,471,923 | A | * | 12/1995 | Carroll et al. | 101/32 |

(Continued)

*Primary Examiner* — Jermie Cozart

(74) *Attorney, Agent, or Firm* — Andrew C. Cheng

(57) ABSTRACT

The present invention provides a method and an apparatus for manufacturing a back frame for flat panel display devices. The method contains the steps of: delivering a material belt to a stamping device; conducting a first stamping at a region of a mold in the stamping device corresponding to a first work location of a stamping process; moving the material belt or mold move a next work location after completing the first stamping; conducting a second stamping at a region of the same mold corresponding to a second work location of the stamping process by the same stamping device; and obtaining the main pieces and braces for the back frame after sequentially completing the stampings by the same stamping device and the same mold. The present invention as described is capable of saving the costs for the stamping device, mold, and material.

12 Claims, 10 Drawing Sheets

(56) References Cited

U.S. PATENT DOCUMENTS 5,515,591 A * 5/1996 Reynolds et al. ..... 29/407.1
5,595,111 A * 1/1997 Michael et al. ..... 100/207
5,706,696 A * 1/1998 Wagner ..... 72/351
6,000,322 A * 12/1999 To ..... 100/35
6,516,507 B2 * 2/2003 Noel et al. ..... 29/505

* cited by examiner

METHOD FOR MANUFACTURING BACK FRAME FOR FLAT PANEL DISPLAY DEVICE

BACKGROUND OF THE INVENTION

1. Field of the Invention

The present invention relates to the field of liquid crystal displaying techniques, and in particular to a method and apparatus for manufacturing a back frame for flat panel display devices.

2. The Related Arts

According to existing technology, a liquid crystal display (LCD) device contains a front frame, a display panel, and a backlight system. The backlight system contains a back frame, a reflection plate, a light guide plate, and a light assembly.

Currently the LCD devices on the market are of various dimensions so as to fit consumers' requirements. Taking LCD TV as example, the display panel can be 31.5", 42", 36", 48", or 55". For display panels of different dimensions, different back frames have to be prepared.

FIG. 1 is a schematic diagram showing the structure of a back frame of a conventional LCD device. As illustrated, the conventional back frame 10 is integrally formed usually by metal stamping or plastic injection molding. The integrally-formed back frame 10 consumes more material and therefore has a higher material cost. In addition, a large-sized back frame 10 requires a larger stamping device. The mold for a large-sized back frame 10 is also bigger and structurally more complex, contributing to a higher molding cost. Therefore, in general, a large-sized, integrally-formed back frame 10 is more expensive to manufacture.

Therefore it is desirable to have assembly-type back frame, and an assembly-type back frame requires multiple braces to install circuit board, etc. of the LCD device. The braces usually have physical structures such as protrusions, vias, etc., and these various physical structures require stamping processes involving different locations and apparatuses. In addition, different stamping molds are also required for these locations and processes, thereby increasing the molding cost of the braces.

SUMMARY OF THE INVENTION

The technical issue to be addressed by the present invention is to provide a method and an apparatus for manufacturing a back frame for flat panel display devices that can save the costs for the stamping device, mold, and material.

To resolve the technical issue, the present invention provides a method for manufacturing a back frame for a flat panel display device. The method contains the steps of: delivering a material belt to a stamping device; conducting a first stamping on the material belt at a region of a mold in the stamping device corresponding to a first work location of a stamping process so as to achieve one of forming protrusion, forming via, and flipping side to the material belt; after finishing the first stamping, moving the mold or material belt for a distance to a next work location; after moving to the next work location, conducting a second stamping on the material belt at a region of the same mold in the same stamping device corresponding to a second work location of the stamping process; and obtaining a main piece or a brace required by the back frame after finishing sequentially the stampings on the material belt by the same mold in the same stamping device; and joining at least a first main piece and a second main piece to form the back frame, wherein at least two joining sections are configured at an end of the first main piece along the length of the first main piece at an interval, each matching structurally an end of a corresponding second main piece; and the brace is for connecting the main pieces.

Preferably, before or after a joining section is chosen according a required dimension of the back frame and the end of the corresponding second main piece is joined to the chosen joining section of the first main piece, the other joining sections of the first main piece outside the chosen joining section are cut off.

Preferably, each joining section is an indentation on a surface of the first main piece whose shape matches the end of the corresponding second main piece so as to receive the end of the corresponding second main piece.

Preferably, a protrusion is configured on a surface at the end of the corresponding second main piece; and the protrusion is received by a notch in the chosen joining section so that the first and second main pieces are joined together.

To resolve the technical issue, the present invention provides another method for manufacturing a back frame for a flat panel display device. The method contains the steps of: delivering a material belt to a stamping device; conducting a first stamping on the material belt at a region of a mold in the stamping device corresponding to a first work location of a stamping process; after finishing the first stamping, moving the mold or material belt for a distance to a next work location; after moving to the next work location, conducting a second stamping on the material belt at a region of the same mold in the same stamping device corresponding to a second work location of the stamping process; and obtaining a main piece or a brace required by the back frame after finishing sequentially the stampings on the material belt by the same mold in the same stamping device; and joining at least a first main piece and a second main piece to form the back frame, wherein at least two joining sections are configured at an end of the first main piece, each matching structurally an end of a corresponding second main piece; one of the joining sections of the first main piece is joined to the end of the corresponding second main piece; and the brace is for connecting the main pieces.

Preferably, each of the first and second stampings is one of forming protrusion, forming via, and flipping side.

Preferably, one of the joining sections of the first main piece is chosen in accordance with a required dimension of the back frame.

Preferably, before or after a joining section is chosen according a required dimension of the back frame and the end of the corresponding second main piece is joined to the chosen joining section of the first main piece, the other joining sections of the first main piece outside the chosen joining section are cut off.

Preferably, the joining sections are arranged along the length of the first main piece at an interval.

Preferably, each joining section is an indentation on a surface of the first main piece whose shape matches the end of the corresponding second main piece so as to receive the end of the corresponding second main piece.

Preferably, a protrusion is configured on a surface at the end of the corresponding second main piece; and the protrusion is received by a notch in the chosen joining section so that the first and second main pieces are joined together.

To resolve the technical issue, the present invention also provides an apparatus for manufacturing a back frame for flat panel display devices. The apparatus contains a material feeding device, a stamping device, and a mold; wherein the mold is configured in the stamping device and has two regions corresponding to at least a first work location and a second work location of a stamping process; the material feeding device delivers a material belt to where the mold is positioned; the stamping device conducts a first stamping and a second stamping at the two regions of the mold corresponding to the first work location and the second work location so as to obtain the main pieces and the braces for forming the back frame; and the back frame contains at least a first main piece and a second main piece, and a plurality of braces; at least two joining sections are configured at an end of the first main piece, each matching structurally an end of a corresponding second main piece; the first main piece is joined to the corresponding second main piece through one of its joining sections; the braces are for connecting main pieces.

Preferably, the mold is configured with main patterns for the main pieces; and the main patterns are configured with sub patterns for the at least two joining sections at an end of the main pieces.

Preferably, patterns are configured at different regions of the mold for forming protrusion, forming via, or flipping side of the main pieces or braces.

Compared to the prior arts, the benefits of the present invention are as follows. By having at least two main pieces, at least two joining sections on the first main piece, joining an end of the second main piece to a joining section of the first main piece, the back frame of the present invention is structurally simple, of a low cost, with less material, so that the production cost of the flat panel display device is reduced. In addition, the present invention integrates different work locations of a stamping process for the main pieces and braces sequentially onto a single mold. As such, the mold for the braces are omitted, and there is no need to switch molds after completing a stamping process. The cost to the stamping device is also reduced and the production efficiency to the flat panel display device is enhanced.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 1:
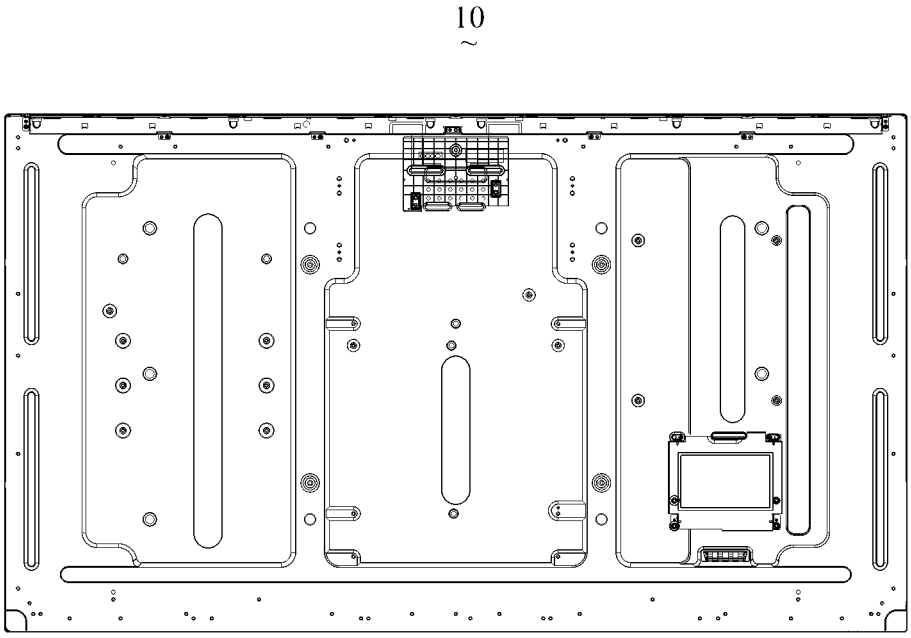
FIG. 1 is a schematic diagram showing the structure of a back frame of a conventional LCD device.
Figure 2:
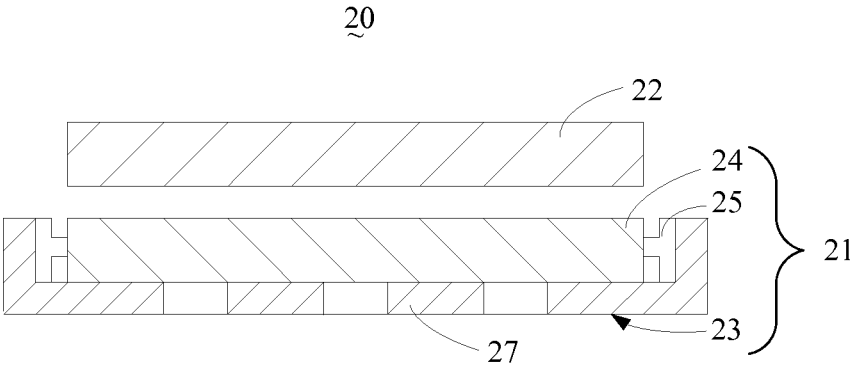
FIG. 2 is a schematic diagram showing the structure of a flat panel display device according to a first embodiment of the present invention.
Figure 3:
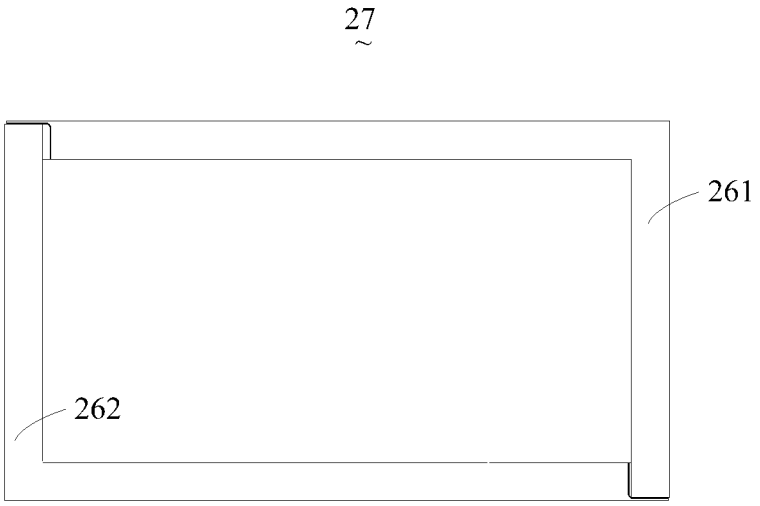
FIG. 3 is a schematic diagram showing the structure of a back frame of a flat panel display device according to a second embodiment of the present invention.

FIG. 2 is a schematic diagram showing the structure of a flat panel display device according to a first embodiment of the present invention. FIG. 3 is a schematic diagram showing the structure of a back frame of a flat panel display device according to a second embodiment of the present invention. As illustrated in FIG. 2, the flat panel display device 20 contains a backlight system 21 and display panel 22. The backlight system 21 is configured behind the display panel 22 and provides illumination to the display panel 22.

In the present embodiment, the backlight system 21 contains a light source 25, a uniforming device 24, and a back frame 23. If this is an edge-lit backlight system 21, the uniforming device 24 is a light guide plate. If this is a direct-lit backlight system 21, the uniforming device 24 is a diffusing plate. The back frame 23 contains at least a first main piece and a second main piece, jointly forming a main frame 27 of the back frame 23.

As shown in FIG. 3, a first embodiment of the back frame 23 contains a first main piece 261 and a second main piece 262. An end of the first main piece 261 is joined to an end of the second main piece 262, and another end of the first main piece 261 is joined to another end of the second main piece 262, thereby forming the main frame 27 of the back frame 23.

The first and second main pieces 261 and 262 are made of aluminum or zinc-plated steel. In the present embodiment, the first and second main pieces 261 and 262 are L-shaped.

Figure 4:
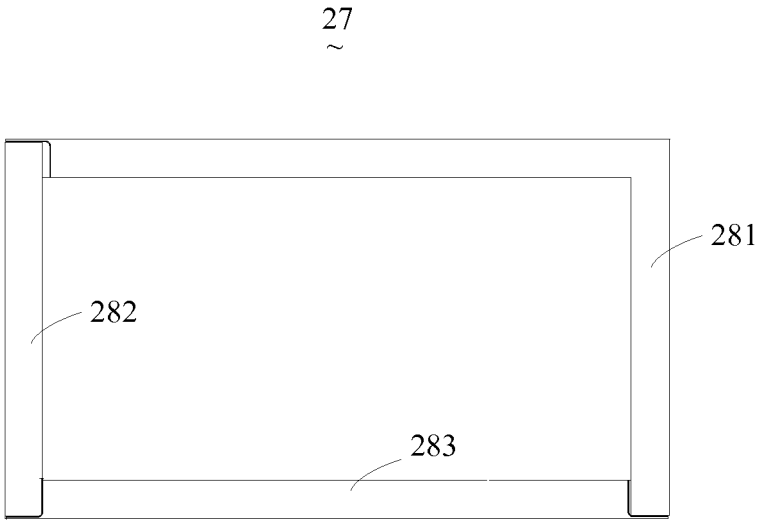
FIG. 4 is a schematic diagram showing the structure of a back frame of a flat panel display device according to a third embodiment of the present invention.

As shown in FIG. 4, a second embodiment of the back frame 23 contains a first main piece 281, a second main piece 282, and a third main piece 283, jointly forming the main frame 27 of the back frame 23. The first, second, and third main pieces 281, 282, and 283 are made of aluminum or zinc-plated steel. In the present embodiment, the first main pieces 281 is L-shaped, the second and third main pieces 282 and 283 are elongated rectangles.

The back frame 23 can further contain auxiliary pieces configured in the main frame 27.

In the following embodiments, the back frame 23 of the flat panel display device 20 involves four main pieces and two auxiliary pieces.

Figure 5:
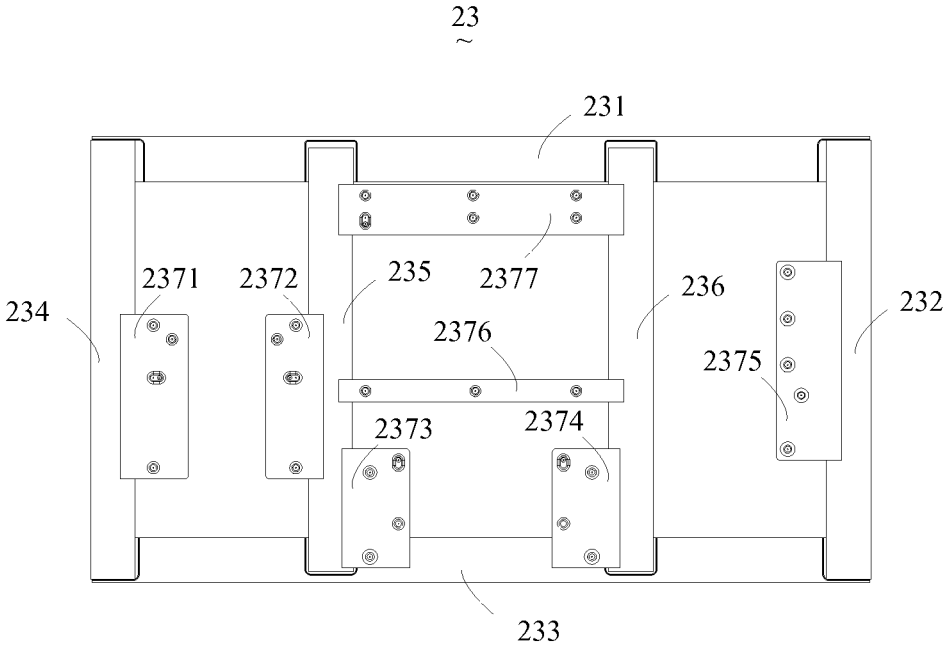
FIG. 5 is a schematic diagram showing the structure of a back frame of a flat panel display device according to a fourth embodiment of the present invention.

FIG. 5 is a schematic diagram showing the structure of a back frame of a flat panel display device according to a fourth embodiment of the present invention. As illustrated, the back frame 23 contains a first main piece 231, a second main piece 232, a third main piece 233, a fourth main piece 234, a first auxiliary piece 235, a second auxiliary piece 236, and braces 2371, 2372, 2373, 2374, 2375, 2376, and 2377. The first to fourth main pieces 231, 232, 233, and 234 jointly form the main frame 27 of the back frame 23 by end-to-end connection with one another. The first and second auxiliary pieces 235 and 236 are configured in and joined to the main frame 27.

Specifically, an end of the first main piece 231 is joined to an end of the second main piece 232, another end of the second main piece 232 is joined to an end of the third main piece 233, another end of the third main piece 233 is joined to an end of the fourth main piece 234, and another end of the fourth main piece 234 is joined to another end of the first main piece 231, thereby forming the rectangular main frame 27. The first to fourth main pieces 231, 232, 233, and 234 are made of aluminum or zinc-plated steel. In the present embodiment, the first to fourth main pieces 231, 232, 233, and 234 are elongated rectangles. In alternative embodiments, the first to fourth main pieces 231, 232, 233, and 234 can all be L-shaped or some of them are elongated rectangles and some are L-shaped. For example, as shown in FIG. 3, the first and second main pieces 261 and 262 are both L-shaped and, as shown in FIG. 4, the first main piece 281 is L-shaped whereas the second and third main pieces 282 and 283 are elongated rectangles.

Figure 6:
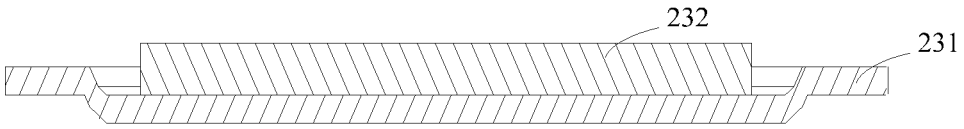
FIG. 6 is a schematic diagram showing the assembly structure of a flat panel display device according to a fifth embodiment of the present invention.

In the present embodiment, the back frame 23 of the flat panel display device 20 is assembled by piecing the main and auxiliary pieces together. As shown in FIG. 6, which exemplifies the connection of an end of the first main piece 231 and an end of the second main piece 232, an end of the second main piece 232 is joined to an end of the first main piece 231 by means such as bolting, fastening, or welding.

Figure 7:
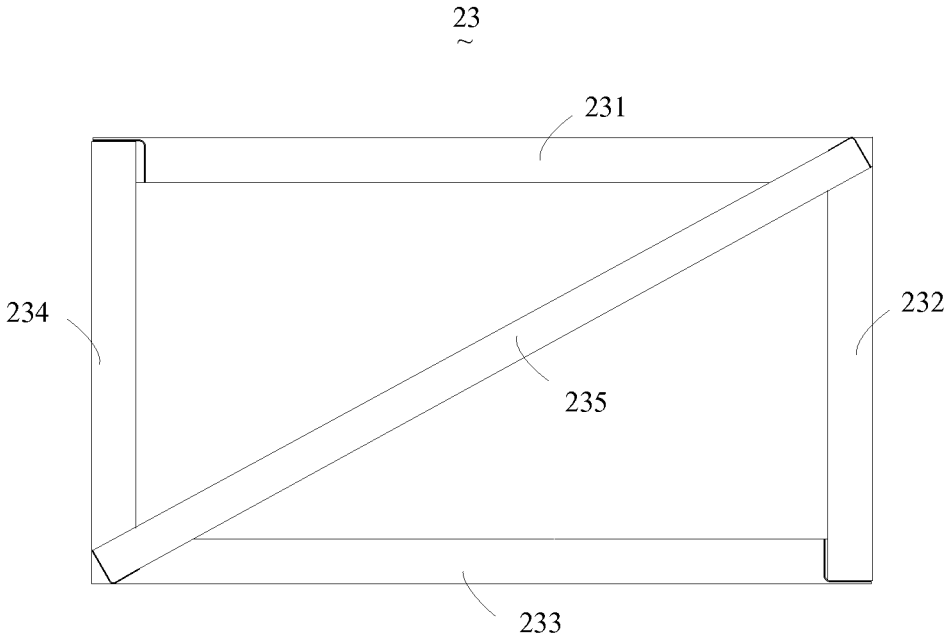
FIG. 7 is a schematic diagram showing a first auxiliary piece diagonally configured on a main frame of a flat panel display device according to a sixth embodiment of the present invention.
Figure 8:
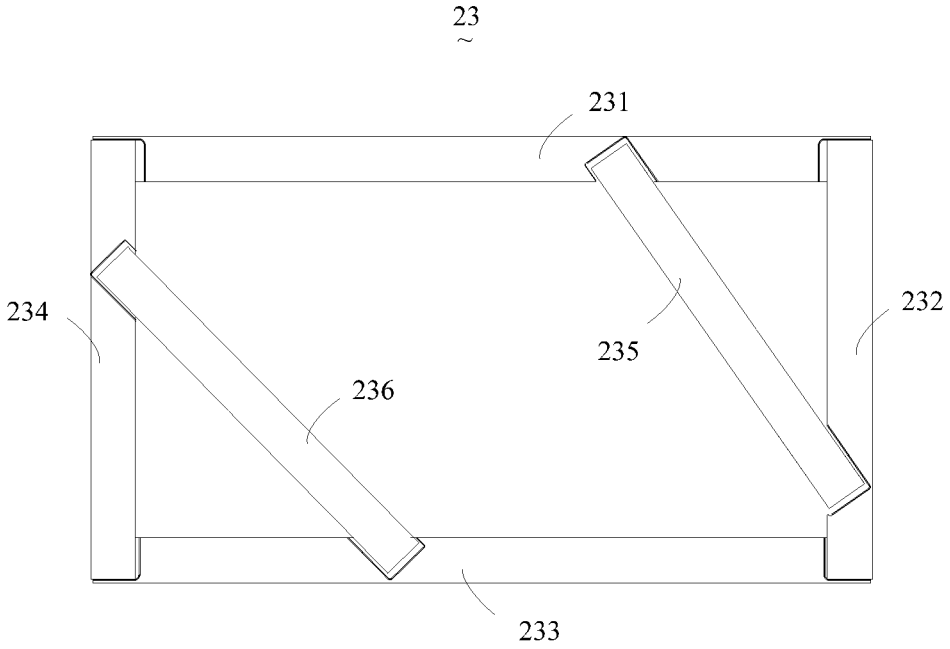
FIG. 8 is a schematic diagram showing a first auxiliary piece and a second auxiliary piece configured on a main frame of a flat panel display device according to a sixth embodiment of the present invention.

In the preset embodiment, the first and second auxiliary pieces 235 and 236 are configured in the main frame 27 of the back frame 23. An end of the first auxiliary piece 235 is joined to the first main piece 231, another end of the first auxiliary piece 235 is joined to the third main piece 233, an end of the second auxiliary piece 236 is joined to the first main piece 231, another end of the second auxiliary piece 236 is joined to the third main piece 233, and the second and fourth main pieces 232 and 234, the first and second auxiliary pieces 235 and 236 are arranged in parallel. In alternative embodiments, at least an auxiliary piece is configured in the main frame 27, such as having only the first auxiliary piece 235 configured in the main frame 27. In addition, the first auxiliary piece 235 can have its two ends joined to at least two of the first to fourth main pieces 231, 232, 233, and 234, such as the first auxiliary piece 235's configuration in the main frame 27 as shown in FIG. 7. Similarly, the second auxiliary piece 236 can have its two ends joined to at least two of the first to fourth main pieces 231, 232, 233, and 234, such as the first auxiliary piece 235's two ends are joined to the neighboring first and second main pieces 231 and 232, respectively, and the second auxiliary piece 236's two ends are joined to the neighboring third and fourth main pieces 233 and 234, respectively, as shown in FIG. 8.

In the present embodiment, the back frame 23 contains seven braces 2371, 2372, 2373, 2374, 2375, 2376, and 2377. The brace 2371 is fixed to the fourth main piece 234, the braces 2372 and 2373 are fixed to the first auxiliary piece 235, the brace 2374 is fixed to the second auxiliary piece 236, the brace 2375 is fixed to the second main piece 232, and the two ends of the braces 2376 and 2377 are fixed to the first and second auxiliary pieces 235 and 236, respectively. In fact, each brace can be fixed to one or more of the first to fourth main pieces 231, 232, 233, and 234, and the first and second auxiliary pieces 235 and 236. In alternative embodiments, braces of various numbers can be configured on the back frame 23 such as having one or more braces. In addition, each brace can be detachably fixed to one or more of the first to fourth main pieces 231, 232, 233, and 234, and the first and second auxiliary pieces 235 and 236.

The braces 2371, 2372, 2373, 2374, 2375, 2376, and 2377 all have protrusions configured (not shown), and circuit boards etc. are fixed to the back frame 23 through the protrusions.

In the following, the molds for the back frame 23 are described. In the present embodiment, the first and third main pieces 231 and 233 are of the same shape and dimension, and therefore can be stamped using the same mold. The second and fourth main pieces 232 and 234, and the first and second auxiliary pieces 235 and 236 are of the same shape and dimension, and therefore can be stamped using the same mold. In other words, the molds can be shared for the main and auxiliary pieces, and the back frame 23 can be produced using two molds of smaller dimensions, in contrast to the larger-dimensioned mold required by the conventional back frame 10. The molds for the back frame 23 of the present invention are smaller and structurally simpler, thereby reducing the cost of the molds for the back frame 23. On the other hand, compared to the integrally formed back frame 10, the back frame 23 of the present invention requires significantly less material and the flat panel display device 20 enjoys a lower production cost.

Figure 9:
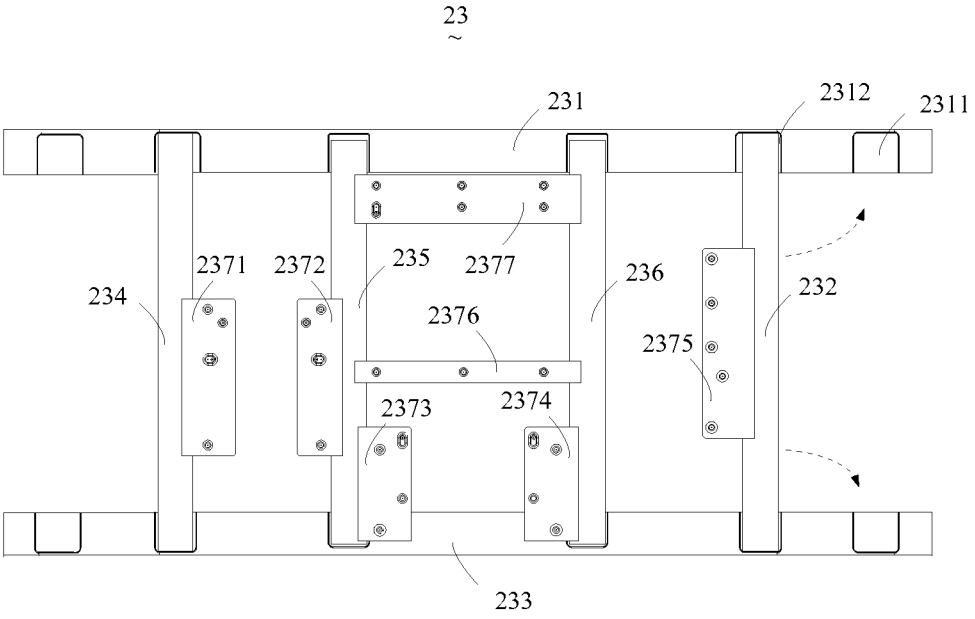
FIG. 9 is a schematic diagram showing the structure of a back frame's joining section of a flat panel display device according to a eighth embodiment of the present invention.

FIG. 9 is a schematic diagram showing the structure of a back frame of a flat panel display device according to an eighth embodiment of the present invention. As illustrated, an end of the first main piece has two joining sections structured to match an end of the second main piece so as to join the end of the second main piece to the first main piece.

Figure 10:
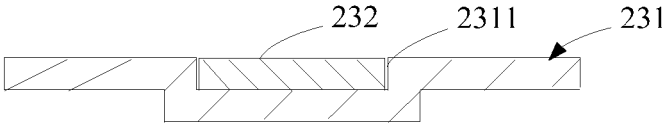
FIG. 10 is a cross-sectional diagram showing the joining section of FIG. 9.

Specifically, an end of the first main piece 231 has two joining sections 2311 and 2312 arranged at an interval along the length of the first main piece 231. The joining sections 2311 and 2312 are indentations on the first main piece 231 whose shapes match an end of the second main piece 232 so as to receive the end of the second main piece 232. As illustrated in FIG. 10, the joining sections 2311 and 2312 are indentations of a rectangular shape that does not run laterally and completely across the first main piece 231. The second main piece 232 is an elongated rectangle.

Figure 11:
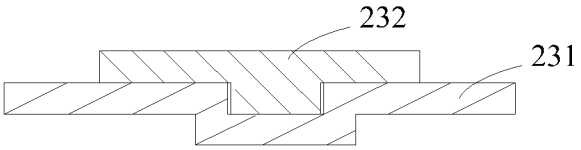
FIG. 11 is a cross-sectional diagram showing the structure of a back frame's joining section of a flat panel display device according to a ninth embodiment of the present invention.

To assemble the back frame 23 of a larger dimension, the joining section 2311 that is closer to the end of the first main piece 231, and a second main piece 232 of a compatible width are chosen. Then, an end of the second main piece 232 is placed in the joining section 2311 and, subsequently, the end of the second main piece 232 is joined to the joining section 2311 through bolting, fastening, or welding. To assemble the back frame 23 of a smaller dimension, the joining section 2312 that is farther from the end of the first main piece 231, and a second main piece 232 of a compatible width are chosen. Then, an end of the second main piece 232 is placed in the joining section 2312 and, subsequently, the end of the second main piece 232 is joined to the joining section 2312 through bolting, fastening, or welding. Alternatively, a protrusion can be configured on a surface at the end of the second main piece 232 and the protrusion is received by a notch in the joining section 2311 or 2312 so that the first and second main pieces 231 and 232 are joined together, as shown in FIG. 11. Additionally, there can be two, three, or four protrusions arranged at intervals on a surface along the length of the second main piece 232.

Figure 12:
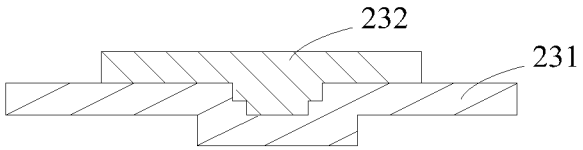
FIG. 12 is a cross-sectional diagram showing the structure of a back frame's joining section of a flat panel display device according to a tenth embodiment of the present invention.
Figure 13:
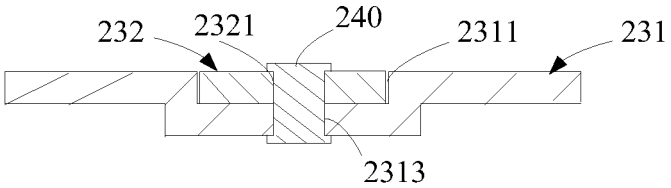
FIG. 13 is a cross-sectional diagram showing the structure of a back frame's joining section of a flat panel display device according to a eleventh embodiment of the present invention.

Furthermore, the joining sections 2311 or 2312 of the first main piece 231 can be a stepped indentation and correspondingly the second main piece 232 is configured with a stepped protrusion, as shown in FIG. 12. In addition, using the joining section 2311 as example as shown in FIG. 13, a first through hole 2313 is configured in the joining section 2311 and a second through hole 2321 is configured at a corresponding location on the second main piece 232. The back frame 23 further contains a fastener 240 running through the first and second through holes 2313 and 2321 so as to join the first and second main pieces 231 and 232 together.

Figure 14:
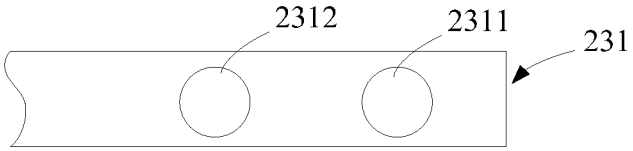
FIG. 14 is a schematic diagram showing the structure of a back frame's joining section of a flat panel display device according to a twelfth embodiment of the present invention.

As shown in FIG. 14 where the structure of a back frame of a flat panel display device according to another embodiment of the present invention is depicted, the joining sections 2311 and 2312 of the first main piece 231 are circular. Alternatively, the joining sections 2311 and 2312 can also be of a triangular shape or other polygonal shape.

Figure 15:
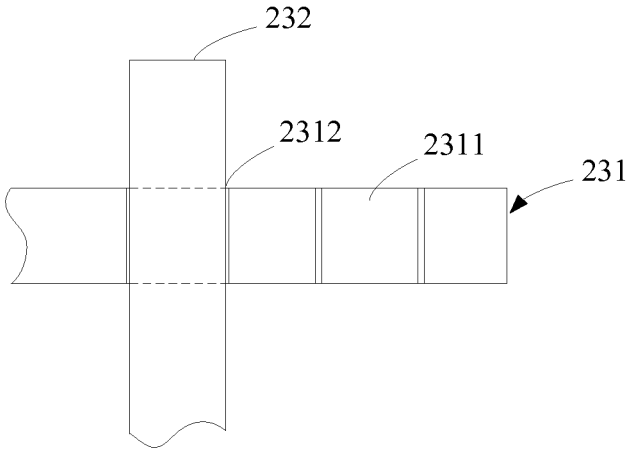
FIG. 15 is a schematic diagram showing the structure of a back frame's joining section of a flat panel display device according to a thirteenth embodiment of the present invention.

As shown in FIG. 15 where the structure of a back frame of a flat panel display device according to another embodiment of the present invention is depicted, the joining sections 2311 and 2312 are indentations of a rectangular shape that runs laterally and completely across the first main piece 231. As such, the end of the second main piece 232 can move along the joining section 2311 or 2312. For example, after the end of the second main piece 232 is joined to the joining section 2312, the extraneous part of the second main piece 232 that runs beyond of the joining section 2312 can be cut off so as to adjust the length of the second main piece 232 as it functions as a main piece for the back frame 23.

The other end of the first main piece 231 and the both ends of the third main piece 233 all have two joining sections whose structures are identical to those of the joining sections 2311 and 2312. The both ends of the second and fourth main pieces 232 and 234, depending on different conditions, could be designed differently. The following are some examples.

In a first condition as shown in FIG. 10, nothing is configured at both ends of the second and fourth main pieces 232 and 234. In other words, their ends are identical structurally to the other parts. Then, when selecting the joining section 2311 (or 2312) of the first main piece 231 for connection (the other end is processed accordingly), the length of the second and fourth main pieces 232 and 234 are determined correspondingly so as to fit the various width requirements of the back frame 23. In other words, if the joining section 2311 that is closer to the end of the first main piece 231 is chosen, the second and fourth main pieces 232 and 234 are not cut, or are cut for a shorter section. If the joining section 2312 that is farther from the end of the first main piece 231 is chosen, the second and fourth main pieces 232 and 234 are both cut. Depending on the distance between the chosen joining section and the end of the first main piece 231, the cut section is longer or shorter accordingly.

In a second condition as shown in FIG. 11, which is similar to the previous condition, different protrusions are employed on the second and fourth main pieces 232 and 234 so as to join with the first and third main pieces 231 and 233, respectively, and to fulfill the width variation of the back frame 23. Similarly, when the joining section 2312 other than the joining section 2311 that is closer to the end of the first main piece 231 is chosen, the extraneous part of the second and fourth main pieces 232 and 234 are cut, before or after the connection.

The above conditions also apply to the embodiment when the main frame 27 of the back frame 23 is formed by joining two L-shaped main pieces.

In summary, the first main piece of the back frame 23 has at least two joining sections and the exact number of the joining sections can vary in accordance with requirement. The present embodiment is described with two joining sections 2311 and 2312. When preparing molds for the back frame 23, only two molds are required. One if for the first main piece and the other for the second main piece. The first main piece can be configured with a number of joining sections for assembling back frames 23 of different dimensions and, when assembling a back frame 23, appropriate joining section is chosen based on the dimension of the back frame 23. Through the joining section, the second main piece is joined to the joining section of the first main piece and the other joining sections of the first main piece outside the chosen joining section can be cut off so as to obtain the back frame 23 of desired dimension. In contrast to the prior art where back frames 10 of different dimensions require different molds, the back frame 23 of the present invention only requires a mold for the first main piece and a mold for the second main piece, fulfilling the demand of mold sharing. Additionally, the molds are structurally simple, thereby reducing the cost of the molds for the back frame.

The present invention also provides a mold for producing the back frame for a flat panel display device. The mold is configured with main patterns for the main pieces, and the main patterns are configured with sub patterns for the at least two joining sections at an end of the main pieces. The main pieces here are referred to the above-mentioned first and second main pieces. The joining sections are referred to the joining sections on the first main piece mentioned above. The details are omitted here.

Figure 16:
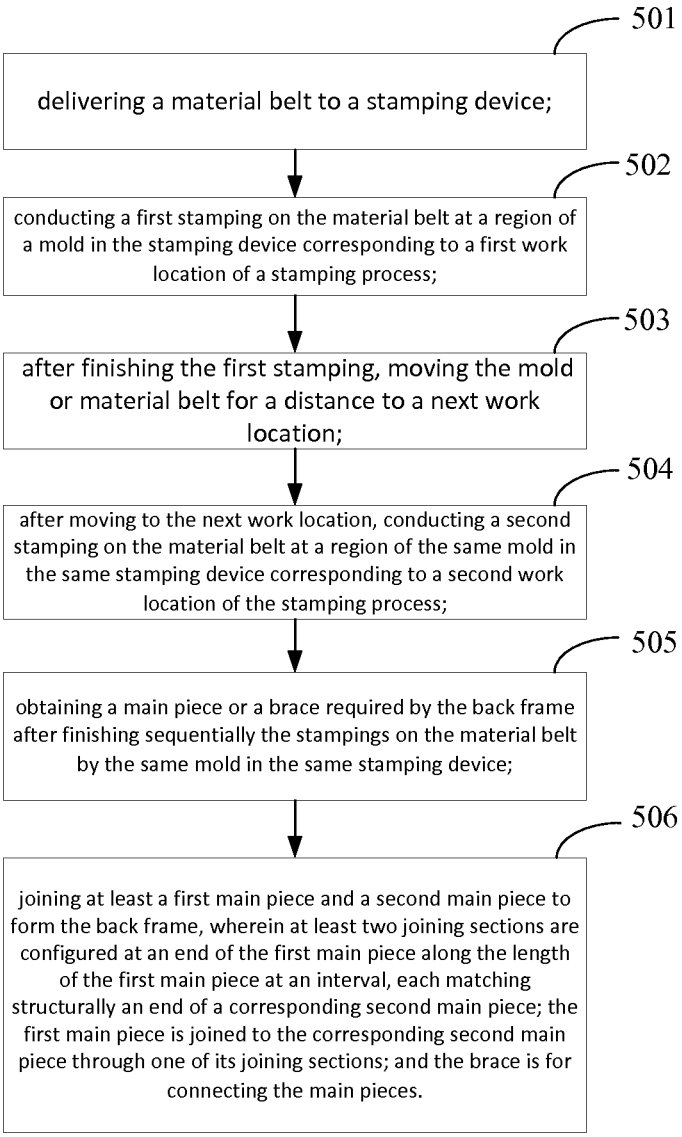
FIG. 16 is flow diagram showing the steps of producing a back frame of a flat panel display device according to a fourteenth embodiment of the present invention.

As shown in FIG. 16, the present invention provides a method for producing a back frame for a flat panel display device. The method contains the following steps.

In step 501, a material belt is delivered to a stamping device.

The stamping device is to apply force to raw material such as the material belt so that the raw material is deformed in accordance with the configured shape of the mold, and that work pieces conforming to the shape of the mold are obtained.

In step 502, a first stamping is conducted on the material belt at a region of the stamping device' mold corresponding to a first work location's stamping process.

Every stamping performed by the stamping device can accomplish a single stamping job of a stamping process corresponding to a work location of the mold. A mold can integrate according to a sequential order different work locations of a stamping process. The stamping device follows the sequential order to complete the stamping process sequentially.

The first stamping described above can be forming protrusion, forming via, or flipping side.

In step 503, after finishing the first stamping, the mold or material belt is moved for a distance to a next work location.

After finishing a stamping, the mold has to be moved relative to the stamping device to a next work location of the same stamping device so as to conduct the stamping process of the next work location. In the meantime, the material belt has to be moved to the next work location synchronously with the movement of the mold. Of course, the movement of the mold and material belt to the next work location is not limited to the way described above. For example, it is also possible to keep the mold and material belt still whereas the stamping device is moved relative to the mold so that the next work location is moved to where the mold and material belt currently is.

In step 504, after moving to the next work location, a second stamping is conducted on the material belt at a region of the same mold of the same stamping device corresponding to a second work location's stamping process.

In step 505, a main piece or brace required by the back frame is obtained after finishing sequentially the stampings on the material belt by the same mold in the same stamping device.

In step 506, at least two main pieces, one first and one second, are joined to form the back frame. At least two joining sections are configured at an end of the first main piece along the length of the first main piece at an interval, each matching structurally an end of a corresponding second main piece. The first main piece is joined to the corresponding second main piece through one of its joining sections. The brace is for connecting the main pieces. The joining structure of the back frame is identical to the joining structure of above-described embodiments, and the details are therefore omitted here.

The main pieces for forming the back frame can have different physical structures. The braces for connecting the main pieces can also have different physical structures. These different physical structures usually require different molds and stamping processes conducted at different work locations. Yet according to the present invention, a single mold that integrates the formation of these physical structures in accordance with a sequential order is provided. The mold is then placed in a stamping device and, after delivering a material belt through the stamping device, the material belt is stamped sequentially at regions of different work locations of the mold. After each stamp, the mold and material belt are moved to the next work location until the stamping processes at all work locations are carried out, thereby producing the main pieces and braces required by a back frame. Through the present invention, all main pieces and braces are formed with a single mold. The mold cost is therefore reduced. Furthermore, there is no need to change mold after each stamping process. The process is as such significantly simplified. The production efficiency of the back frames to flat panel display devices is also greatly enhanced.

Figure 17:
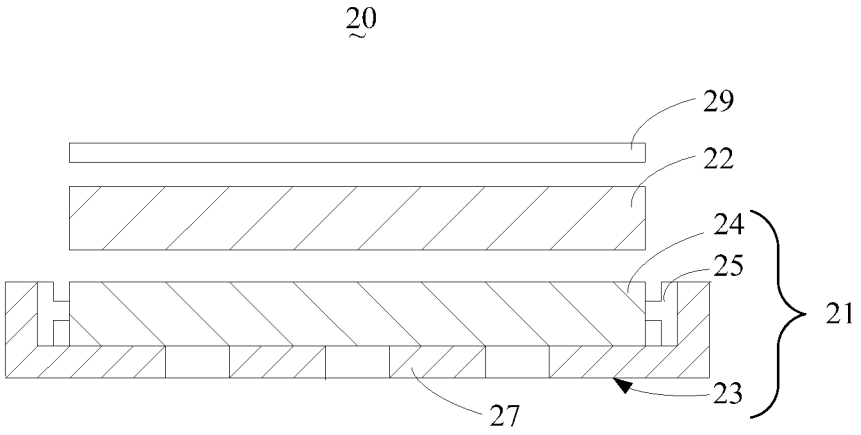
FIG. 17 is a schematic diagram showing the structure of a flat panel display device with a touch panel according to a fifteenth embodiment of the present invention.

As shown in FIG. 17, the flat panel display device 20 of the present invention further contains a touch panel 29 configured on a light emission plane of the display panel 22 of the flat panel display device 20. The flat panel display device 20 contains a backlight system 21 and the above-mentioned display panel 22. The backlight system 21 is configured behind the display panel 22 and provides illumination to the display panel 22.

The backlight system 21 contains a light source 25, a uniforming device 24, and a back frame 23. The back frame 23 supports the light source 25 and the uniforming device 24. If this is an edge-lit backlight system 21, the uniforming device 24 is a light guide plate. If this is a direct-lit backlight system 21, the uniforming device 24 is a diffusing plate. The back frame 23 contains at least a first main piece and a second main piece, jointly forming the main frame 27 of the back frame 23.

Of course the backlight system 21 can be structured according to any one of the embodiments described above.

It should be noted that the flat panel display device 20 can be a LCD device or a LCD TV.

Figure 18:
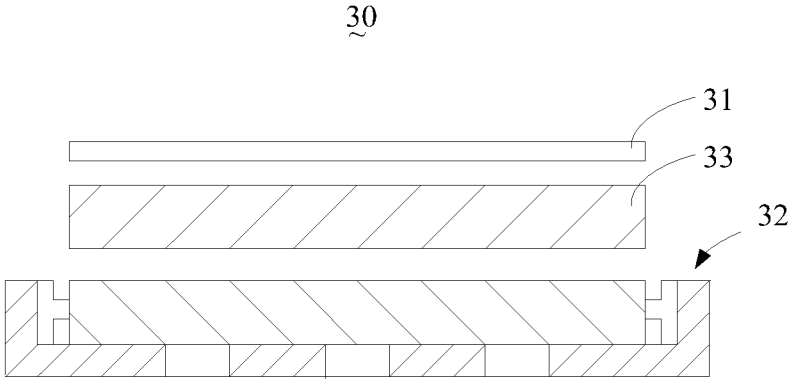
FIG. 18 is a schematic diagram showing the structure of a 3D display device according to a sixteenth embodiment of the present invention.

The present invention further provides a 3D display device 30. As shown in FIG. 18, the 3D display device 30 contains a liquid crystal lens grating 31, a backlight system 32, and a display panel 33. The liquid crystal lens grating 31 is configured on a light emission plane of the display panel 33. The backlight system 32 can be structured according to any one of the embodiments described above (e.g., the backlight system 32 contains a back frame 23). The back frame 23 contains at least a first main piece and a second main piece, jointly forming the main frame of the back frame. The backlight system 32 can be structured according to any one of the embodiments described above. The details are omitted here.

Figure 19:
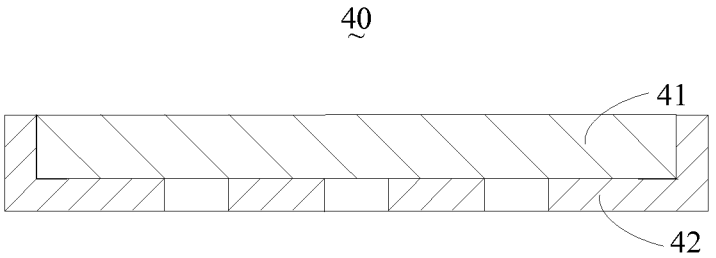
FIG. 19 is a schematic diagram showing the structure of a plasma display device according to a seventeenth embodiment of the present invention.

The present invention further provides a plasma display device 40. As shown in FIG. 19, the plasma display device 40 contains a plasma display panel 41 and a back frame 42 configured behind the plasma display panel 41. The back frame 42 can be structured according to any one of the embodiments described above. The details are omitted here.

Through the above described methods, a flat panel display device, a 3D display device, or a plasma display device can have a structurally simple mold for their back frames, thereby significantly reducing the costs for the mold and for the back frame material, and the flat panel display devices.

Figure 20:
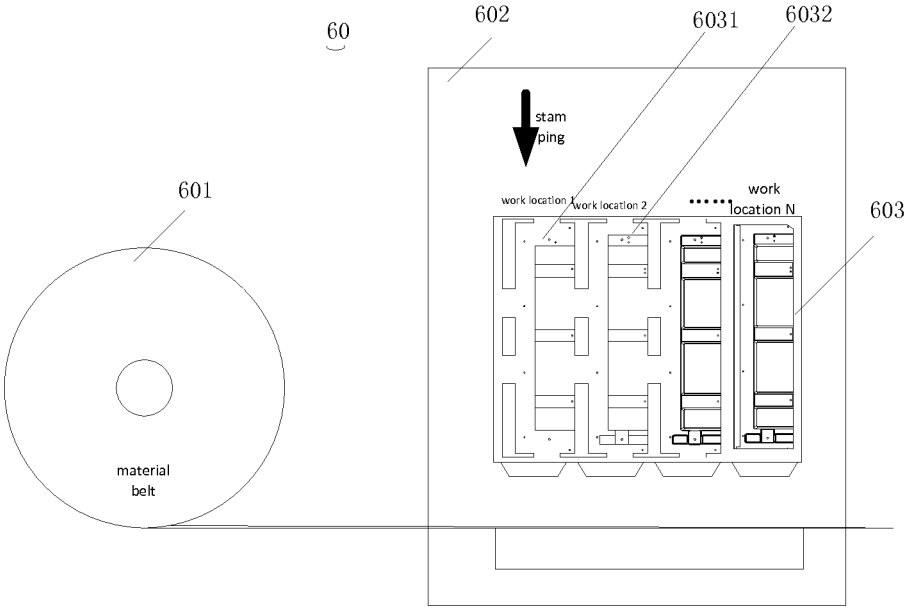
FIG. 20 is a schematic diagram showing the structure of an apparatus for manufacturing a back frame for flat panel display devices.

The present invention further provides an apparatus 60 for manufacturing a back frame for flat panel display devices as shown in FIG. 20, which is a schematic diagram showing the structure of the apparatus 60. As illustrated, the apparatus 60 contains a material feeding device 601, a stamping device 602, and a mold 603.

The mold 603 has two regions corresponding to at least a first work location and a second work location for forming the main pieces of the back frame and the braces for connecting the main pieces. The mold 603 is configured in the stamping device 602.

The material feeding device 601 delivers a material belt to where the mold 603 is positioned. The stamping device 602 conducts a first stamping and a second stamping at the regions of the mold 603 corresponding to the first work location 6031 and the second work location 6032 so as to obtain the main pieces and the braces for forming the back frame for flat panel display devices. After a stamping is completed, the mold 603 is moved relative to the stamping device 602 to the next work so as to conduct the next stamping. In the meantime, the material belt is also moved to the next work location in synchrony with the mold 603. Of course, how the mold 603 and the material belt are moved to the next work location is not limited as described. For example, alternatively, the mold 603 and the material belt are kept still whereas the stamping device 602 is moved relative to the mold 603 so that the region of the next work location is moved to where the mold 603 and the material belt are currently located. The first stamping and the second stamping mentioned above are stampings forming protrusions, forming vias, or flipping sides to the material belt at the regions of the mold 603's first and second work locations by the stamping device 602.

The back frame contains at least a first main piece and a second main piece, and a number of braces. At least two joining sections are configured at an end of the first main piece, each matching structurally an end of a corresponding second main piece. The first main piece is joined to the corresponding second main piece through one of its joining sections. The braces are for connecting main pieces. The joining structure of the back frame is identical to the joining structure of above-described embodiments, and the details are therefore omitted here.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A method for manufacturing a back frame for a flat panel display device, comprising the steps of:

delivering a material belt to a stamping device;

conducting a first stamping on the material belt at a region of a mold in the stamping device corresponding to a first work location of a stamping process so as to achieve one of forming protrusion and forming via to the material belt;

after finishing the first stamping, moving the mold or material belt for a distance to a next work location;

after moving to the next work location, conducting a second stamping on the material belt at a region of the same mold in the same stamping device corresponding to a second work location of the stamping process;

obtaining a main piece or a brace required by the back frame after finishing sequentially the stampings on the material belt by the same mold in the same stamping device; and joining at least a first main piece and a second main piece to form the back frame, wherein at least two joining sections are configured at an end of the first main piece along the length of the first main piece at an interval, each matching structurally an end of a corresponding second main piece; and the brace is for connecting the main pieces.

2. The method as claimed in claim 1, wherein, before or after a joining section is chosen according a required dimension of the back frame and the end of the corresponding second main piece is joined to the chosen joining section of the first main piece, the other joining sections of the first main piece outside the chosen joining section are cut off.

3. The method as claimed in claim 1, wherein each joining section is an indentation on a surface of the first main piece whose shape matches the end of the corresponding second main piece so as to receive the end of the corresponding second main piece.

4. The method as claimed in claim 1, wherein a protrusion is configured on a surface at the end of the corresponding second main piece; and the protrusion is received by a notch in the chosen joining section so that the first and second main pieces are joined together.

5. A method for manufacturing a back frame for a flat panel display device, comprising:

delivering a material belt to a stamping device;

conducting a first stamping on the material belt at a region of a mold in the stamping device corresponding to a first work location of a stamping process;

after finishing the first stamping, moving the mold or material belt for a distance to a next work location;

after moving to the next work location, conducting a second stamping on the material belt at a region of the same mold in the same stamping device corresponding to a second work location of the stamping process;

obtaining a main piece or a brace required by the back frame after finishing sequentially the stampings on the material belt by the same mold in the same stamping device; and joining at least a first main piece and a second main piece to form the back frame, wherein at least two joining sections are configured at an end of the first main piece, each matching structurally an end of a corresponding second main piece; one of the joining sections of the first main piece is joined to the end of the corresponding second main piece; and the brace is for connecting the main pieces.

6. The method as claimed in claim 5, wherein each of the first and second stampings is one of forming protrusion and forming via.

7. The method as claimed in claim 5, wherein one of the joining sections of the first main piece is chosen in accordance with a required dimension of the back frame.

8. The method as claimed in claim 7, wherein, before or after a joining section is chosen according a required dimension of the back frame and the end of the corresponding second main piece is joined to the chosen joining section of the first main piece, the other joining sections of the first main piece outside the chosen joining section are cut off.

9. The method as claimed in claim 5, wherein the joining sections are arranged along the length of the first main piece at an interval.

10. The method as claimed in claim 9, wherein each joining section is an indentation on a surface of the first main piece whose shape matches the end of the corresponding second main piece so as to receive the end of the corresponding second main piece.

11. The method as claimed in claim 9, wherein a protrusion is configured on a surface at the end of the corresponding second main piece; and the protrusion is received by a notch in the chosen joining section so that the first and second main pieces are joined together.

12. The method as claimed in claim 9, wherein at least two protrusions are configured at an interval on a surface at the end along the length of the corresponding second main piece.

* * * * *